United States Patent [19]

Garg et al.

[11] Patent Number: 4,707,006

[45] Date of Patent: Nov. 17, 1987

[54] DOOR LATCH ASSEMBLY

[75] Inventors: Yogesh K. Garg, Wooster; Robert E. Hoffacker, Millersburg, both of Ohio

[73] Assignee: Camrey Industries, Inc., Wooster, Ohio

[21] Appl. No.: 824,320

[22] Filed: Jan. 31, 1986

Related U.S. Application Data

[63] Continuation of Ser. No. 514,775, filed as PCT US81/01345, Oct. 6, 1981, abandoned.

[51] Int. Cl.[4] ..... E05C 9/10

[52] U.S. Cl. ..... 292/336.3; 292/DIG. 31; 292/DIG. 36

[58] Field of Search ..... 292/DIG. 31, DIG. 36, 292/336.3, 113, 167, 171, 223, 225, 123, 347, 36, 38, 48, 50, 26, 28

[56] References Cited

U.S. PATENT DOCUMENTS

| | | | |
|---|---|---|---|
| 554,701 | 2/1896 | Krupp | 292/199 X |
| 912,379 | 2/1909 | Jackson | 292/38 |
| 1,552,690 | 9/1925 | Frantz . | |
| 2,039,296 | 5/1936 | Collins . | |
| 2,402,348 | 6/1946 | Schroeder | 292/167 |
| 2,534,693 | 12/1950 | Adams | 292/223 |
| 2,649,322 | 8/1953 | Mack | 292/173 |
| 2,657,085 | 10/1953 | Dedoes | 292/169 |
| 2,700,887 | 2/1955 | Oxhandler et al. | 70/451 |
| 2,708,356 | 5/1955 | Long | 292/DIG. 36 |
| 2,719,423 | 10/1955 | Hammerly | 70/81 |
| 2,871,048 | 1/1959 | Balogh | 292/173 |
| 2,916,905 | 12/1959 | Podlesak | 70/150 |
| 3,743,336 | 7/1973 | Andrews | 292/DIG. 31 X |
| 3,990,278 | 11/1976 | Perelson | 70/120 |
| 4,195,867 | 4/1980 | Baillie | 292/174 |

OTHER PUBLICATIONS

Eberhard Mfg. Co. Catalog, Section 8, p. 10, Copyright 1976.

*Primary Examiner*—Richard E. Moore

*Attorney, Agent, or Firm*—Watts, Hoffmann, Fisher & Heinke Co.

[57] ABSTRACT

A door latch assembly is disclosed for unlatching and opening a door in one motion. The assembly comprises a housing adapted to be mounted on a door and having a handle pivotally mounted about an axis perpendicular to the direction the door opens. A cam driver having a cam surface is fixed to the handle so that the cam driver will pivot with the handle. A cam link is connected with the cam surface of the cam driver to translate pivotal motion of the handle into linear motion. A dish having a cam surface is rotatably mounted on the housing. The cam surface of the dish is in contact with the cam link such that linear motion of the cam link causes rotational motion of the dish. A latch is connected to the dish such that rotation of the dish disengages the latch. When the handle is lifted in the direction the door opens, the dish rotates and unlatches and opens the door.

17 Claims, 10 Drawing Figures

DOOR LATCH ASSEMBLY

This application is a continuation of application Ser. No. 514,774, filed June 2, 1983, now abandoned.

DESCRIPTION

1. Technical Field

The present invention relates to door latches and is particularly directed to a door latch assembly for use with overhead doors such as garage doors that will permit the operator to unlatch and open the door with one motion.

2. Background Art

The prior art discloses several different types of door latch assemblies. One such proposal suggests a plate pivotally mounted to the center of an upright door. The pivotal axis of the plate would be perpendicular to the door plane with the latch mechanisms connected by chains to the outer periphery of the plate. The plate would have a handle attached to it in order to rotate the plate. First, the handle would be rotated and held to disengage the latches. Then an upward force would be applied to another handle in order to pull the door up. It would be necessary to use two hands to open a door equipped with such a door latch. One hand would be used to rotate the latching mechanism and to hold it in the rotated position and a second hand would be used to apply an upward force to the door via a second handle attached to the door.

Other prior art proposals suggest the use of a spring-loaded door latch assembly in which the latches would typically be spring-loaded in an engaged position. A key would be inserted into a lock which would automatically release the locking mechanism and retract the latches once the key is turned. Such a device would again require a two-step process, (1) of retracting the latches by use of a key and (2) a second motion to lift the door. Also, once the latches are disengaged, they would remain in a disengaged position even though the door is again closed. Another operation of turning handle would be necessary to again engage the latches.

DISCLOSURE OF THE INVENTION

The invention provides a new and improved door latch assembly particularly adapted for use on overhead garage doors. The new door latch assembly in accordance with the present invention is designed to disengage the door latches and open the door in one motion thereby making the opening of an overhead door easier.

The door latch assembly in accordance with the present invention includes a housing mounted in a door aperture. A handle is movably mounted to the housing. A dish is rotatably carried on the housing. A latch is operatively connected to the dish such that rotation of the dish disengages the normally closed latch. A means is operatively connected to the handle and to the dish for rotating the dish when force is applied to the handle in the general direction the door opens.

In the preferred embodiment, a housing having a front side and back side is mounted in an aperture of a door such as an over-head garage door. The handle is pivotally mounted to the housing about an axis approximately perpendicular to the direction that the door opens. The handle is preferably mounted on the front side of the housing which is the exterior of the door. An arm having a cam surface projects from the handle. The cam surface of the arm extends through an opening in the housing to the back side of the housing. A cam link is slidably mounted to the back of the housing on the interior side of the door and in contact with the cam surface of the arm. Applying a force to the door handle in the general direction the door opens causes the door handle to pivot which drives the cam surface of the arm which in turn slides the cam link in a linear motion parallel with the plane of the door. A dish is rotatably carried by the housing on the interior side of the door. The dish has a cam surface which is in contact with the cam link. Linear motion of the cam link causes the dish to rotate. A normally closed latch mechanism is connected to the dish so that rotation of the dish will disengage or open the latch. In the case of an overhead door the handle will be mounted in a plane parallel with the door and mounted such that an upward force, which is needed to open the door, will also pivot the handle. Once the handle pivots, the cam surface of the arm drives the cam link which rotates the dish and thereby unlatches the door. Continued force on the handle will open the door. Thus one motion of the handle upward is all that is needed to unlatch and to open the door.

Another feature of the improved apparatus is that a lock is also provided which is slidably mounted to the housing on the interior side. A receiving channel in the dish will receive the slide lock. Once the slide lock is positioned within the receiving channel of the dish, the dish is prevented from rotating, thus locking the latching assembly.

Still another feature of an embodiment using the present invention is that the dish is spring biased to oppose the rotational motion that opens the latch. The spring bias of the dish will cause the dish to rotate back to the normal position that permits latch engagment once the opening force is removed from the handle.

Several advantages are realized by using the apparatus of this invention over prior art devices. An overhead door equipped with this apparatus will be unlatched and opened with only one force being applied to the handle in the general direction the door opens. Since only one force is needed to perform both functions, separate handles would not be required for lifting of the door. The elimination of the need for additional handles saves not only the expense of the handles, but also saves the expense of aligning, drilling and mounting the handles onto the door.

The apparatus according to the present invention provides several advantages to door manufacturers. The door only requires one aperture to mount the assembly. As mentioned above, the mounting of extra handles is not required. Once the apparatus is mounted, it lies fairly flush with the face of the door. This flush profile not only provides an improved aesthetic appearance to the door, it allows a more compact packaging of the door for shipping purposes.

The flush profile of the apparatus of the present invention eliminates parts which protrude from the face of the door as are present in some prior art devices that could cause injury to persons or objects that accidentally contact the assembly.

The door latch assembly can be made from a polymer material which prevents corrosion and makes the assembly less expensive to manufacture than an all metal assembly would be. If a polymer material is used, the assembly can be easily colored during the manufacturing process, or by painting to add to the doors asthetic appearance. The assembly also provides a weather-tight device.

The apparatus of the present invention also improves the locking security of the door. A positive action is required to lock the assembly or door thus preventing accidental locking. The assembly can be locked or unlocked from either side of the door. If a locked apparatus was attempted to be opened by force such as a prying the handle and the handle were to be broken off, the device and in turn the door would still remain in a locked condition.

Other features and advantages and a fuller understanding of the invention will be had from the following detailed description and the accompanying drawings.

BEST MODE FOR CARRYING OUT THE INVENTION

Figure 1:
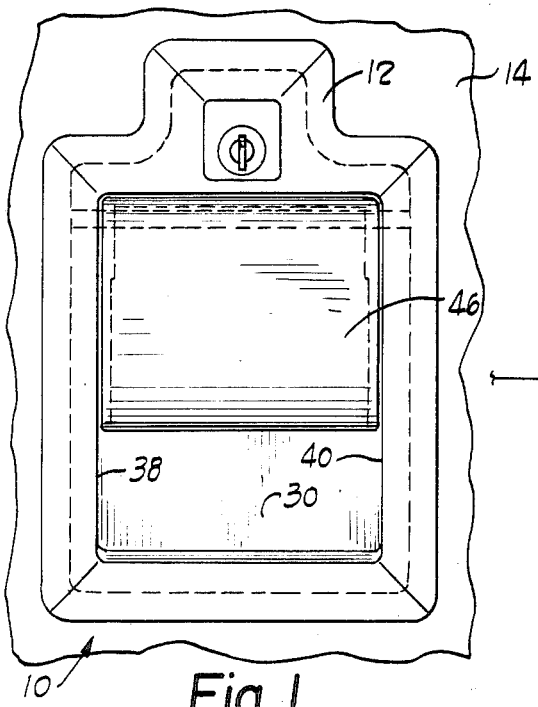
FIG. 1 is a front elevation view of the present invention.
Figure 4:
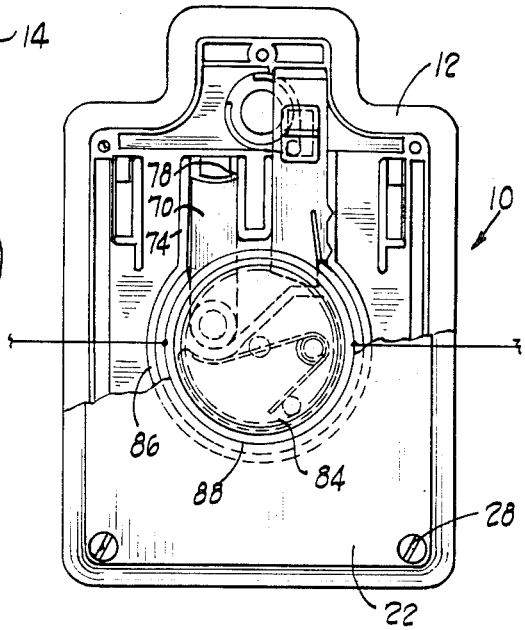
FIG. 4 is a back elevation view of the present invention in the locked, latches engaged position partially assembled.
Figure 5:
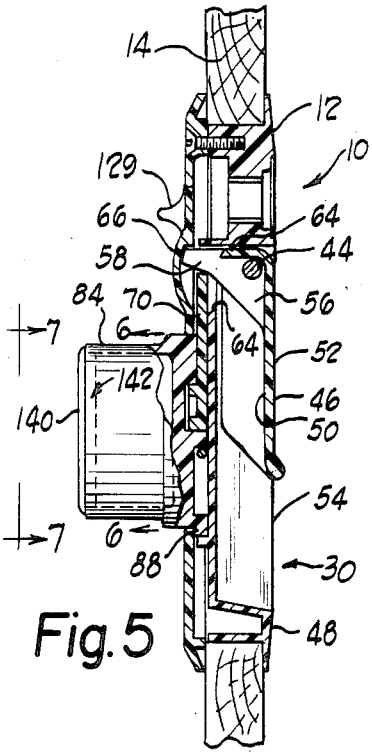
FIG. 5 is a sectional view taken along lines 5—5 of FIG. 2.
Figure 8:
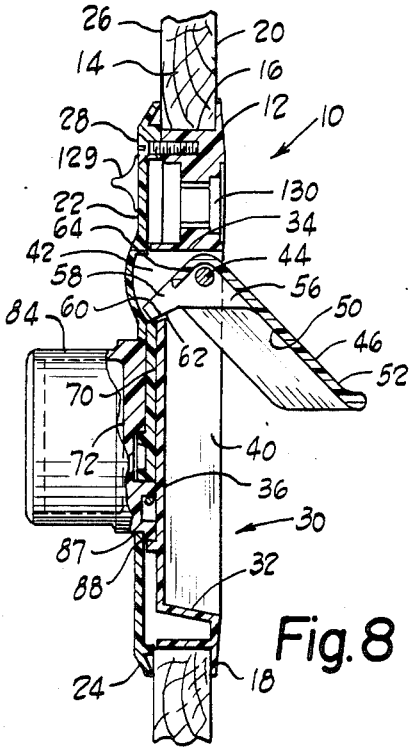
FIG. 8 is a side sectional view taken along the lines 8—8 of FIG. 3.
Figure 2:
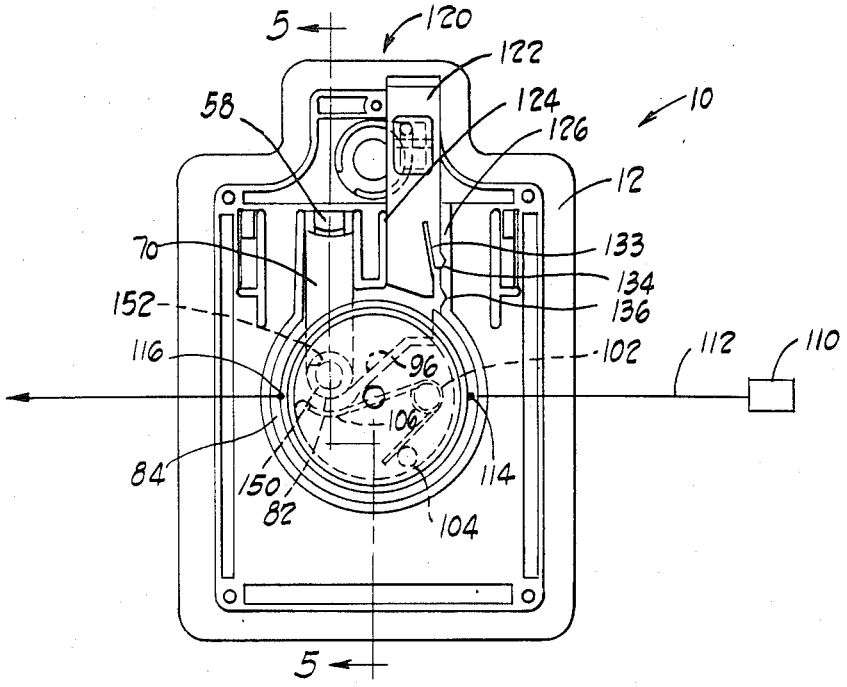
FIG. 2 is a back elevation view of the present invention in the unlocked, latches engaged position, partially assembled.
Figure 3:
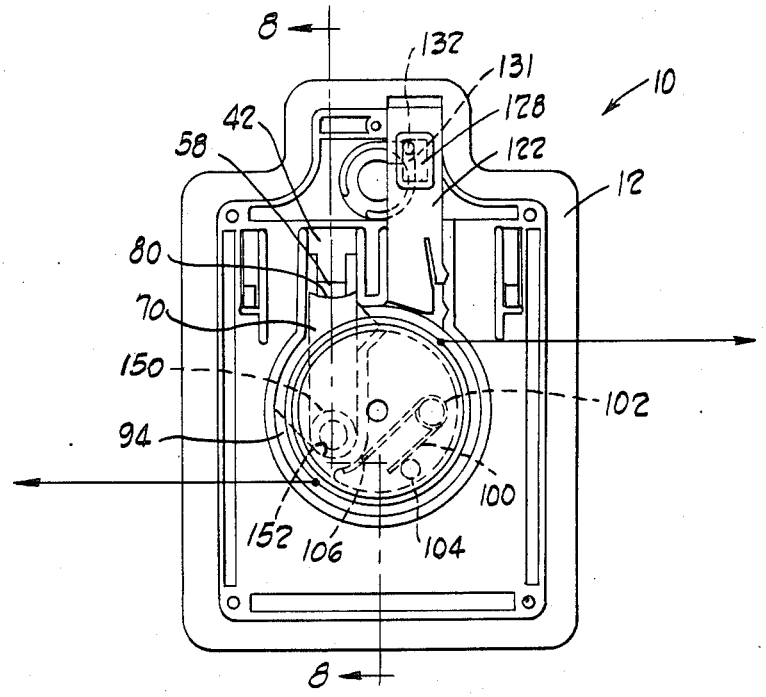
FIG. 3 is a back elevation view of the present invention in the unlocked, latches disengaged open position, partially assembled.

Referring now to the figures, the door latch assembly 10 of the apparatus embodying the present invention has a housing 12 mounted on a door 14. It is contemplated that the door latching assembly can be used on doors such as overhead garage doors and the like which typically require a lifting force to be applied to open the door. Therefore, in order to better understand the present invention, it will be assumed that the door latch assembly 10 is adapted to be mounted on an overhead garage door.

The housing 12 is mounted in an aperture 16 of door 14. The housing has an extension surface 18 which engages the outside surface 20 of door 14. A back plate 22 is provided which attaches to the back of housing 12. The back plate 22 has an extension surface 24 which overlies and engages the inside surface 26 of door 14. Screws 28 are provided to secure the back plate 22 to the housing 12.

The housing 12 has a recessed area 30 which is defined by a bottom wall 32, a top wall 34, a back wall 36 and side walls 38, 40. The back wall 36 of the recessed area 30 has an opening 42.

A mounting rod 44 is fixedly attached to housing 12 and is located in the recessed area 30. The mounting rod 44 is approximately perpendicular to the direction the door 14 opens and is parallel to the plane of the door. A handle 46 is pivotally mounted to the mounting rod 44. The handle 46 has a spaced pair of apertured flanges that receive the mounting rod 44. The handle is dimensioned to fit flush with the outer surface 48 of the housing 12 when the handle is in the normal position. The handle 46 has an interior gripping surface 50 which is parallel with the outside surface 52 of the handle. The mounting rod 44 is located near the top wall 34 of the recessed area 30. The handle 46 extends downward toward the bottom wall 32 but leaves an opening 54. The interior gripping surface 50 of the handle 46 is spaced apart from the back wall 36 of the recessed area 30. The recessed area 30 and the handle 46 are dimensioned to permit an operator to insert his hand into the opening 54 and permit his fingers to contact the gripping surface 50. Force applied against the gripping surface 50 will cause the handle 46 to pivot about the mounting rod 44.

A cam driver 56 is fixed to the handle 46. The cam driver 56 has a hole to receive the mounting rod 44. When the handle 46 pivots about the mounting rod 44, the cam driver 56 will also pivot around the mounting rod. In the preferred and disclosed embodiment the cam driver 56 is an integral part of the handle 46.

The cam driver 56 has an arm 58 that extends outward from handle 46. The arm 58 extends through opening 42 of the housing 12. The cam driver 56 has a cam driving surface 60 that is tapered. It has been found that a tapering angle of 22.5° with respect to the normal of the plane of the handle 46 has worked quite well. When the handle 46 is pivoted sufficiently about the mounting rod 44, the cam driving surface 60 comes in contact with edge 62 defining the opening 42. The edge 62 thus acts as a stop to prevent further pivoting of the handle 46. It is contemplated that handle 46 can have a plurality of arms extending outwardly therefrom and extending through corresponding openings in housing 12, not shown, to provide further stops to the pivotal motion of handle 46 similar to the function provided by arm 58. The handle 46 has an upper surface 64 which contacts the wall 34 when the handle 46 is in the normal position. The back plate 22 has a raised clearing portion 66 that permits clearance of the arm 58 when the handle 46 is pivoted about the mounting rod 44.

A cam link 70 is slidably mounted against surface 72 of the housing 12. Channel guides 74, 78 are provided to guide for reciprocating motion of the cam link 70. Surface 80 of the cam link 70 is in contact with the surface 60 of the cam driver 56. Pivotal motion of the handle 46 and the cam driver 56 about the mounting rod 44 causes the cam surface 60 of the cam driver 56 to force the cam link 70 to slide downward in a plane parallel with that of housing 12. The cam link 70 has a cam driving surface 82 which is circular in shape. A dish 84 is provided and is rotatably carried by the surface 72 of the housing 12. Integral retainer member 86 is provided to aid the dish 84 to remain rotatable in a fixed spacial position with respect to the housing 12. The dish 84 preferably has a circular lip surface 88 which fits within the retaining member 86. The back plate 22 has an opening 87 dimensioned to fit over the dish 84. When the back plate 22 is mounted to the housing 12, the lip surface 88 of the dish 84 comes in contact with the inside surface of the back plate 22 and causes the dish to be retained against the interior surface 72 of the housing 12. The dish 84 still is free to rotate with respect to the housing 12.

The dish 84 has an interior surface 90 that comes in contact with the surface 72 of the housing 12. The interior surface 90 has two recessed areas 92, 94. The recessed area 92 is dimensioned to receive the cam link 70 and still permit at least partial rotation of the dish 84. The recessed area 92 has stop sides 94, 96. When the handle 46 is parallel with the plane of the door 14, the cam link 70 is in contact with the stop side 94 of the recessed area 92. When the handle 46 is pivoted upward, the cam driver 56 rotates about the mounting rod 44. The surface 82 of the cam link 70 drives against the cam surface 98 of the hollow 92 causing the dish 84 to rotate. The linear motion of the cam link causes rotational motion of the dish. The rotational motion of the dish will continue until the stop surface 96 comes into contact with the cam link 70. This preferably occurs for the same amount of pivotal action of the handle that causes the cam driving surface 60 to come in contact with the edge 62 of the hole 42.

A spring 100 is provided in order to provide spring biasing to the rotation of the dish 84 from its normal position. The spring 100 is held in juxtaposition with the housing 12 with mounting posts 102, 104. The spring 100 is located within the recessed area 94 of the dish 84. An arm 106 of the spring 100 will contact a surface 108 of the recessed area 94. When the handle 46 is in the normal or down position, a slight amount of spring biasing force will occur against the surface 108. Once the dish 84 is rotated due to the upward motion of the handle 46, the spring 100 will be forced to coil or compress thus applying a larger spring biasing force against the surface 108. Once the handle is released, the cam surface 98 will drive against the cam link 70 which in turn will cause the handle 46 to return to its normal position.

The present invention contemplates the use of retractable latches 110 of the type that are spring biased. The latches 110 have cables 112 attached thereto which are used to disengage the latches when a pulling force is applied to the cables. In the present invention, the cables 112 are attached to dish 84 through openings 114 and 116 of the dish 84. The cables 112 can be one continuous cable secured to a retaining structure 117 in order to prevent slippage of the cable.

In operation of the disclosed door opener, the operator grasps the handle 46 by inserting his hand into the opening 54 and his fingers against the gripping surface 50. An upward force is then applied to the handle causing the handle to pivot about the mounting rod 44. The tapered surface 60 of the cam driver 56 forces the cam link 70 in a downward direction, causing the dish 84 to rotate. Rotation of the dish 84 causes the cables 112 to move inwardly disengaging the latches 110. The operator continues to apply an upward force to the handle 46 and the door 14 opens. Therefore, the door 14 has been unlatched and opened with one upward movement. Once the handle is released, the dish 84 will return to its original, normal position permitting the latches 110 to move to their engagement position.

The embodiment of the present invention also provides a locking mechanism 120. The locking mechanism 120 includes a locking rod 122 which is slidably mounted against the interior surface 72 of the housing 12. Slide guides 124, 126 are provided for guiding the reciprocating action of the locking rod 122. The dish 84 has a lock receiving portion 128 in the recessed area 92. If the locking rod 122 is slid in a downward direction into the receiving portion 128 of the recess area 92, the dish 84 will be prevented from rotating. If the dish 84 is prevented from rotating, the handle 46 will not be permitted to pivot about the mounting rod 44. When the locking rod 122 is slid into an upward direction not engaging the receiving portion 128 of the recessed area 92, the dish 84 again is free to rotate.

The locking rod 122 has provided a handle extension 129 which permits easy control of the locking rod 122. The locking handle 129 will extend through an opening, not shown, in the back plate 22 to permit access to the locking rod from the interior side of door 14. Also provided is a lock 130 which is accessible with a key, not shown, from preferably the exterior side of the door 14. Rotation of the key in the lock 130 causes the locking rod 122 to slide into or out of engagement with the dish 84. As those skilled in the art will appreciate, a positive action is required to lock the apparatus. Also, the apparatus can be locked or unlocked from either side of the door.

The locking rod 122 has an opening 131 which receives a pin 132 from the lock 130. The locking rod 122 has a position holding arm 133 dimensioned to fit within holding positions 134, 136 of the slide guide 126. The locking rod 122 is made of material such as plastic that permits a certain degree of movement of the position holding arm 133. The holding positions 134, 136 are located along the slide guide 126 such that when the locking rod 122 is disengaged from the dish 84, the hold arm 133 is engaged in hold position 134. When the locking rod 122 is engaged in the portion 128 of the recess area 92, the position arm 133 is engaged in the holding position 136.

The dish 84 has a knurled outer surface 138 for grasping purposes such that the dish 84 can be easily rotated from the interior side of door 14. Also, dish 84 has a cap 140 that is fit over opening 142 of the dish 84. The dish 84 preferably has an opening 144 which is used to aid in mounting the spring in the recessed area 94.

Figure 9:
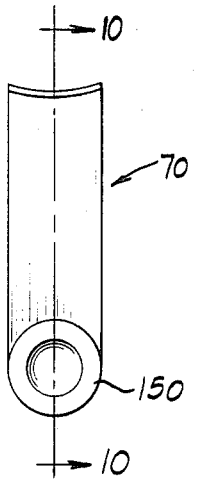
FIG. 9 is a front elevation view of the cam link of the present invention.
Figure 6:
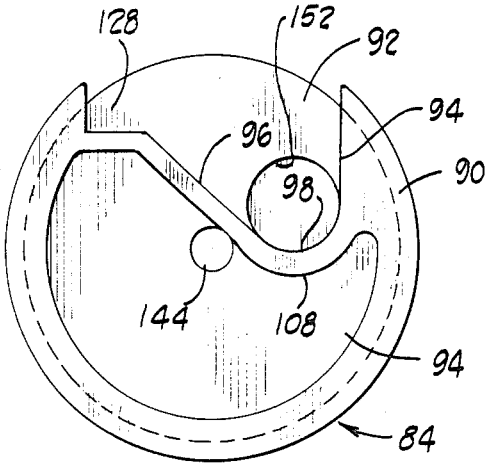
FIG. 6 is a back elevation view taken along lines 6—6 of FIG. 5.
Figure 10:
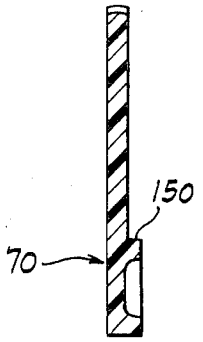
FIG. 10 is a side sectional view of the cam link taken along lines 9—9 of FIG. 9.
Figure 7:
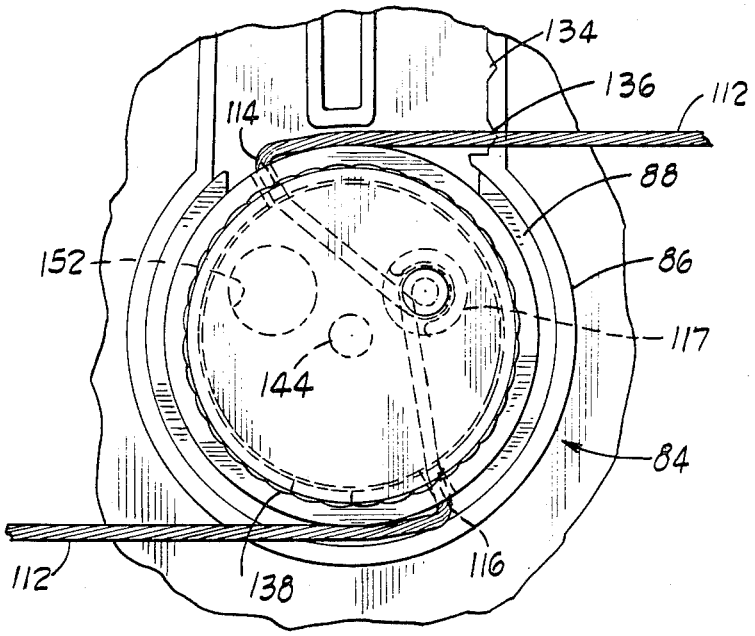
FIG. 7 is a back elevation view of the present invention taken along lines 7—7 partially assembled.

The embodiment of the present invention also provides a positive engagement between the cam link 70 and the dish 84. Referring now to FIGS. 9 and 10, the cam link 70 has an extension arm 150. The dish 84 has a recessed receiving area 152 which is seen in FIG. 6. When assembled, extension arm 150 fits within recessed receiving area 152 to provide a positive engagement.

In the disclosed and preferred embodiment, the apparatus of the present invention is made completely from plastic except for the spring and the mounting rod.

The present invention has been described with reference to overhead doors such as garage doors. It will be apparent to those skilled in the art that this type of locking assembly can be utilized on other types of doors in which it is desired to have only one motion to unlatch and open the door.

Other modifications and variations of the invention will be apparent to those skilled in the art in view of the foregoing detailed disclosure. Therefore, it is to be understood that, within the scope of the appended claims, the invention can be practiced otherwise than as specifically shown and described.

We claim:

1. A door latch asembly comprising:

a housing adapted to be mounted on a door;

a handle movably mounted on said housing;

a dish rotatably mounted on said housing;

a latch connecting structure operatively connected to said dish and adpated to be connected to a door latch such that rotation of said dish will cause disengagement of such latch by causing the latch connecting structure to move; and, means operatively connected to said handle and to said dish for rotating said dish when force is applied to said handle and the handle is thereby moved, the assembly including means to mount the assembly in an orientation such door handle force application both causes dish rotation and applies a force to a connected door in the general direction such door opens.

2. The door latch assembly of claim 1 wherein said handle is pivotally mounted on said housing for pivoting about an axis oriented such that when the assembly is mounted and in use the axis is approximately perpendicular to the direction such door opens.

3. The door latch assembly of claim 1 further comprising a lock means carried by the housing and operable to selectively prevent rotation of said dish when force is applied to said handle.

4. The door latch assembly of claim 1 further comprising a spring bias means operatively connected to said dish for opposing rotational motion of said dish.

5. A door latch assembly for unlatching and opening a door in one motion, said door latch assembly comprising:

a housing adapted to be mounted on such door;

a handle mounted on said housing and being movable;

a cam link having a cam driving surface, said cam link being operatively connected to said handle, movement of said handle causing linear motion of said cam link;

a dish rotatably mounted on said housing, said dish having a cam surface, said cam driving surface of said cam link being operatively connected to said cam surface of said dish such that linear motion of said cam link causes rotational motion of said dish; and, a latch connecting structure operatively connected to said dish and adapted to be connected to a latch such that rotation of said dish will cause latch actuating motion of the connecting structure.

6. The door latch asembly of claim 5 further comprising a lock means for selectively preventing rotation of said dish when force is applied to said handle.

7. The door latch assembly of claim 5 further comprising a spring bias means operatively connected to said dish for opposing rotational motion of said dish.

8. A door latch assembly for unlatching and opening a door in one motion, said door latch assembly comprising:

a housing adapted to be mounted on said door;

a handle pivotally mounted on said housing for pivoting about an axis oriented such that when the assembly is mounted and in use the axis is approximately perpendicular to the direction such door opens;

a cam driver fixed to said handle, said cam driver having a cam surface, pivotal action of said handle driving said cam surface of said cam driver;

a cam link operatively connectd with the cam surface of said cam driver so that pivotal motion of said handle causes linear motion of said cam link;

a dish rotatably mounted on said housing, said dish having a cam surface, said cam link being operatively connected to said cam surface of said dish such that linear motion of said cam link causes rotational motion of said dish; and, a latch connecting structure operativley connected to said dish such that rotation of said dish will cause latch actuating motion of the connecting structure.

9. The door latch assembly of claim 8 further comprising a lock means for selectively preventing said dish from rotating.

10. The door latch assembly of claim 8 further comprising a spring bias means operatively connected to said dish for opposing rotation of said dish.

11. A handle assembly comprising:

a housing adapted to be mounted on a door;

a handle pivotably mounted on said housing;

a cam driver fixed to said handle, said cam driver having a cam surface, pivotal action of said handle driving said cam surface of said cam driver;

a cam link operatively connected with the cam surface of said cam driver so that pivotal motion of said handle causes linear motion of said cam link; and a dish rotatably mounted on said housing, said dish having a cam surface, said cam link operatively connected to said cam surface of said dish, linear motion of said cam link causing rotational motion of said dish.

12. A handle assembly for use in an overhead garage door or the like comprising:

(a) a molded housing having a main body including peripheral side walls and adapted to be disposed in an opening in a door, the housing including a peripheral lip projecting laterally outwardly of the side walls and adapted to overlie a portion of such door and surround such door opening whereby to obscure the opening and form an essentially fluid tight seal between the housing and a connected door;

(b) a handle including a gripping portion and a spaced pair of reinforcing flanges projecting from the gripping portion;

(c) a pivot means interposed between the flanges and the housing and connecting the handle and housing together in relatively pivotal relationship, the housing having an outwardly exposed recess and the handle being disposed in that recess;

(d) a rotatable dish journaled on the housing and projecting rearwardly from the housing;

(e) a camming mechanism interposed between the handle and the dish and operative to cause dish rotation when the handle is pivoted from a normal position recessed in the housing to a door unlatching and opening position;

(f) biasing means biasing the dish and the handle toward their normal positions and into their normal positions at times other than when the handle is pivoted to its door unlatching and opening position; and (g) a latch actuating mechanism forming a part of the assembly and adapted to interconnect the dish with a door latching mechanism and to transmit dish rotation produced door unlatching forces from the assembly to such door latching mechanism.

13. The assembly of claim 12 further including an apertured back plate around the dish and connected to the housing.

14. The assembly of claim 12 further including a back plate fixed to the housing and including another peripheral lip projecting laterally outwardly of the side walls also to overlie a portion of such a connected door and obscure a door aperture.

15. A handle assembly for use in an overhead garage door or the like comprising:

(a) a molded, generally rectangular, housing having a main body including peripheral side walls, the housing being adapted to be disposed in a generally rectangular openino in a door, the housing including a peripheral lip projecting laterally outwardly of the side walls to overlie a portion of the door and surround such a door opening whereby to obscure the opening and provide an essentially fluid tight seal between the housing and a connected door (b) a handle including a gripping portion and a spaced pair of reinforcing apertured flanges projecting from the gripping portion;

(c) a pivot projecting through flange apertures and connected to the housing for connecting the handle and housing together in relatively pivotal relationship, the housing having an outwardly exposed recess and the handle being disposed in that recess;

(d) a rotatable dish journaled in the housing and projecting rearwardly from the housing;

(e) a camming mechanism interposed between the handle and the dish including a lineally movable link to cause dish rotation when the handle is pivoted from a normal position recessed in the housing to a door unlatching and elevating position;

(f) a spring biasing the dish and the handle toward their normal positions and into their normal positions at times other than when the handle is pivoted to its door unlatching and elevating position;

(g) latch actuating cables connected to the dish, the cables being adapted to interconnect the dish with a door latching mechanism and to transmit dish rotation produced door unlatching forces from the assembly to such door latching mechanism;

(h) a lock carried by the housing;

(i) a lock bolt adapted to project into a dish recess in a locking position preventing dish rotation, the lock bolt being operably connected to the lock for lock induced movement from its locking position to an unlocked position; and, (j) an apertured back plate around the dish and connected to the housing, the back plate including another peripheral lip projecting laterally outwardly of the side walls also to overlie a portion of such a connected door and obscure a door aperture, the back plate and housing coacting to retain the other components of the assembly in their assembled positions.

16. A handle assembly comprising:

a housing adapted to be mounted on a door;

a handle pivotally mounted on said housing;

a cam driver fixed to said handle, said cam driver having a cam surface, pivotal action of said handle driving said cam surface of said cam driver;

a cam link operatively connected with the cam surface of said cam driver so that pivotal motion of said handle causes linear motion of said cam link, said cam link having an extension arm; and a dish rotatably mounted on said housing, said dish having a cam surface and a recessed receiving portion, said cam link operatively connected to said cam surface of said dish, said extension arm of said cam link engaged in said recessed receiving portion of said dish, linear motion of said cam link causing rotational motion of said dish.

17. In combination an overhead garage door and a handle assembly, the assembly comprising:

(a) a housing having a main body including side walls disposed in an opening in the door, the housing including a lip projecting laterally overlying a portion of the door opening and partially obscuring the opening and forming a seal between the housing and the door;

(b) a handle including a gripping portion;

(c) a pivot means connecting the handle and housing together in relatively pivotal relationship, the housing having an outwardly exposed recess and the handle being disposed in that recess and accessible from one side of the door;

(d) a rotatable structure journaled on the housing and projecting from the housing oppositely from another side of the door, the rotatable structure being rotatable about an axis which is generally perpendicular to such door;

(e) a mechanism interposed between the handle and the structure and operative to cause structure rotation when the handle is pivoted from a normal position recessed in the housing to a door unlatching and opening position;

(f) biasing means biasing the structure and the handle toward their normal positions and into their normal positions at imes other than when the handle is pivoted toward, into or from its door unlatching and opening position;

(g) a latch actuating mechanism forming a part of the assembly and adapted to interconnect the structure with a door latching mechanism and to transmit structure rotation produced door unlatching forces from the assembly to such door latching mechanism; and (h) the pivot means being located such that continued application of force to move the handle from its normal to its unlatching and opening position will apply opening forces to the door.

* * * * *